US006102475A

United States Patent [19]

Hamann

[11] Patent Number: 6,102,475

[45] Date of Patent: Aug. 15, 2000

[54] STOOL WITH ATTACHED TABLE

[76] Inventor: David Hamann, 4248 Kirby Ave., Cincinnati, Ohio 45223

[21] Appl. No.: 09/074,280

[22] Filed: May 7, 1998

[51] Int. Cl.[7] ..... A47B 39/00; A47B 83/02

[52] U.S. Cl. ..... 297/172; 297/152; 297/157.1; 297/156; 297/170; 297/174; 297/423.1; 297/245; 297/248; 108/27

[58] Field of Search ..... 297/172, 152, 297/156, 157.1, 170, 171, 174, 244, 245, 423.1, 248; 108/27

[56] References Cited

U.S. PATENT DOCUMENTS

| | | | |
|---|---|---|---|
| D. 163,170 | 5/1951 | Eibetz | 297/156 |
| D. 174,016 | 2/1955 | Brulin | 297/172 |
| 275,384 | 4/1883 | Howe | 297/423.1 X |
| D. 322,178 | 12/1991 | Pons | D6/338 |
| 367,037 | 7/1887 | Speakman et al. | 297/172 |
| 681,394 | 8/1901 | Hile | 297/157.1 |
| 844,752 | 2/1907 | Salomon | 297/423.1 X |
| 869,472 | 10/1907 | Agnew | 297/172 X |
| 1,113,140 | 10/1914 | Priest | 297/172 |
| 1,156,232 | 10/1915 | Huntley | 297/172 X |
| 1,209,254 | 12/1916 | Blizard | 297/172 |
| 1,256,811 | 2/1918 | McNamara | 297/172 |
| 1,355,681 | 10/1920 | McNulty | 297/172 |
| 1,454,565 | 5/1923 | Sanford | 297/172 |
| 1,768,427 | 6/1930 | Stevens | 297/172 X |
| 1,884,497 | 10/1932 | Abbott | 297/172 X |
| 1,929,551 | 10/1933 | Hamilton | 297/172 X |
| 1,970,874 | 8/1934 | Yawman | 297/172 |
| 2,023,761 | 12/1935 | Drummey | 297/172 |
| 2,168,910 | 8/1939 | Merrill | 297/172 |
| 2,382,183 | 8/1945 | Thaxton | 297/157.1 |
| 2,529,780 | 11/1950 | Miller | 297/423.1 X |
| 2,664,147 | 12/1953 | O'Keefe et al. | 297/172 |
| 2,673,595 | 3/1954 | Kump, Jr. | 297/172 |
| 2,681,100 | 6/1954 | Hoven et al. | 297/172 |
| 2,716,440 | 8/1955 | Silverman | 297/172 |
| 2,732,007 | 1/1956 | MacWhirter | 297/172 |
| 2,845,110 | 7/1958 | Grawl | 297/157.1 X |
| 2,921,623 | 1/1960 | Humphries et al. | 297/172 X |
| 3,116,088 | 12/1963 | Thaxton | 297/157.1 |
| 3,181,483 | 5/1965 | De Vitt et al. | 108/25 |
| 3,244,125 | 4/1966 | Mackey | 108/25 |
| 3,266,840 | 8/1966 | D'Estrube | 297/170 |
| 3,348,879 | 10/1967 | Merola | 297/170 |
| 3,411,823 | 11/1968 | Bue | 297/170 X |
| 3,596,985 | 8/1971 | Degagne | 297/157.1 |
| 3,606,451 | 9/1971 | Brownfield et al. | 297/174 |
| 4,289,350 | 9/1981 | Thomas et al. | 297/172 |
| 4,526,422 | 7/1985 | Mengshoel et al. | 297/157.1 X |
| 4,738,484 | 4/1988 | Leong | 297/159 |

(List continued on next page.)

FOREIGN PATENT DOCUMENTS

| | | | |
|---|---|---|---|
| 237987 | 1/1960 | Australia | 297/172 |
| 985033 | 7/1951 | France | 297/172 |
| 992519 | 10/1951 | France | 297/172 |
| 1025052 | 4/1953 | France | 297/172 |
| 1037561 | 9/1953 | France | 297/172 |
| 1049792 | 12/1953 | France | 297/172 |
| 1066359 | 6/1954 | France | 297/172 |
| 1072262 | 9/1954 | France | 297/172 |
| 1074140 | 10/1954 | France | 297/172 |
| 1070334 | 3/1955 | France | 297/172 |
| 1096503 | 6/1955 | France | 297/172 |
| 1109156 | 1/1956 | France | 297/172 |
| 1399308 | 5/1965 | France | 297/172 |
| 815232 | 10/1951 | Germany | 297/172 |
| 2737349 | 2/1978 | Germany | 297/172 |
| 480275 | 4/1953 | Italy | 297/172 |
| 616403 | 2/1961 | Italy | 297/172 |

*Primary Examiner*—Peter M. Cuomo
*Assistant Examiner*—Rodney B. White
*Attorney, Agent, or Firm*—Jim Blackwood

[57] ABSTRACT

A device having a table, a stool, and a support structure including footrests, thereby enhancing social environments by the use of varying combinations of the devices, and by providing comfort enhancing features, and specifically by making a seated or standing occupant approachable by increasing the potential for intimacy while yet retaining a defensible position.

60 Claims, 13 Drawing Sheets

U.S. PATENT DOCUMENTS

| | | | |
|---|---|---|---|
| 4,767,159 | 8/1988 | Opsvik | 297/172 X |
| 4,798,411 | 1/1989 | Lin | 297/174 X |
| 4,883,314 | 11/1989 | Sakong | 297/159 |
| 4,998,774 | 3/1991 | Huff et al. | 297/423.1 |
| 5,496,609 | 3/1996 | Michelsteen | 108/27 X |
| 5,697,668 | 12/1997 | Chao | 297/172 |
| 5,782,526 | 7/1998 | Ott | 297/171 X |

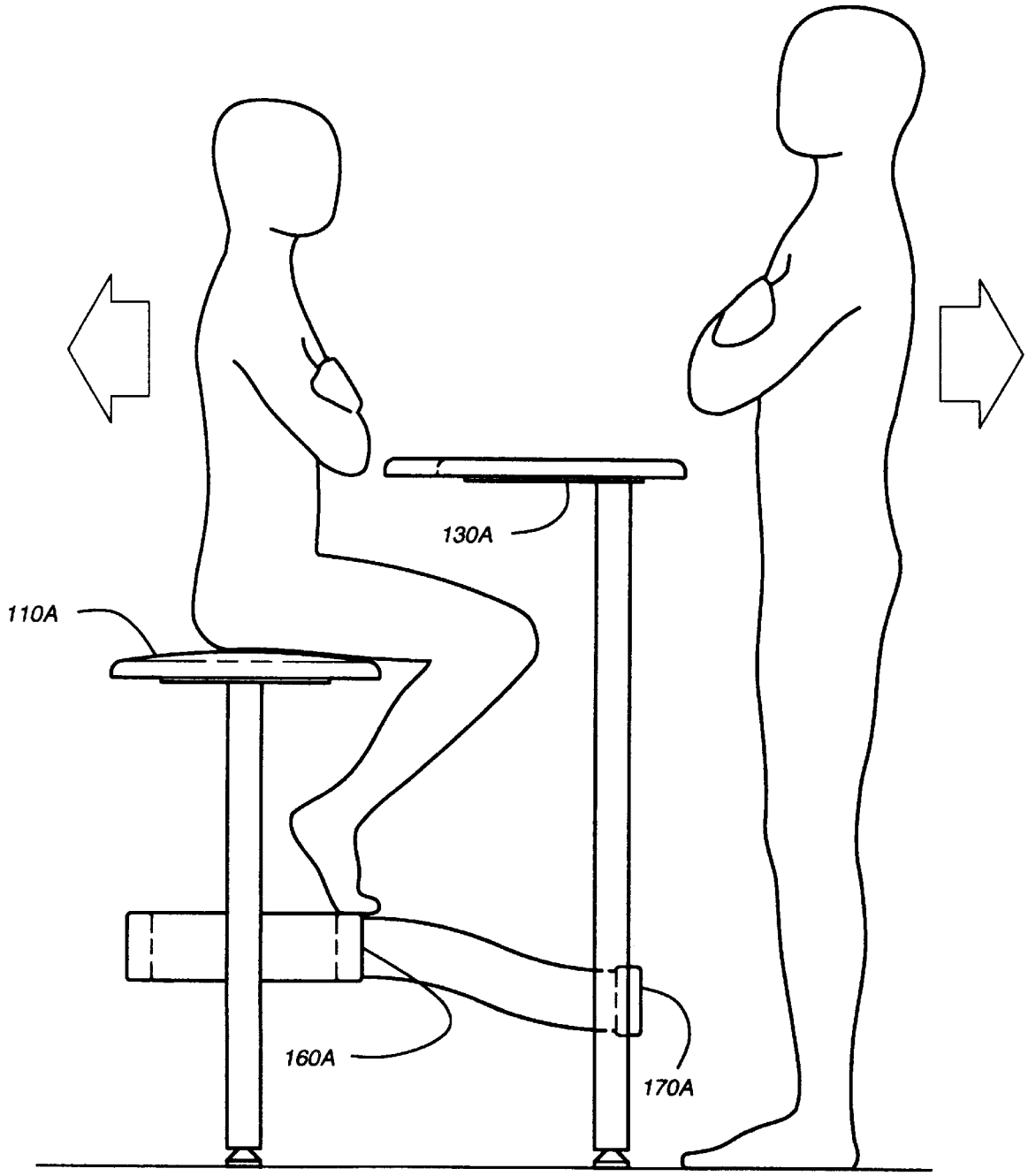
FIG.1B SOCIAL INTERACTION

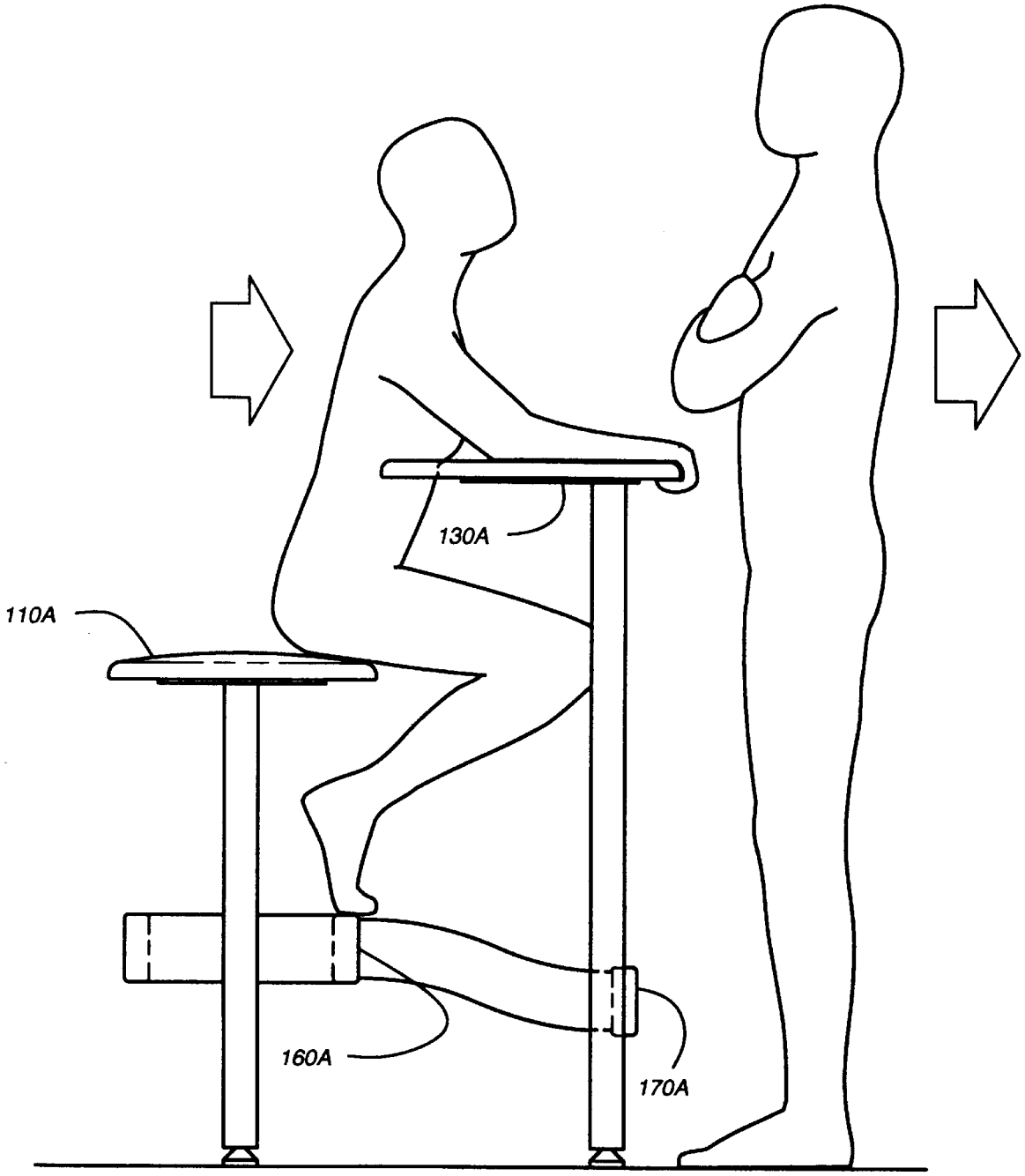
FIG.1C SOCIAL INTERACTION

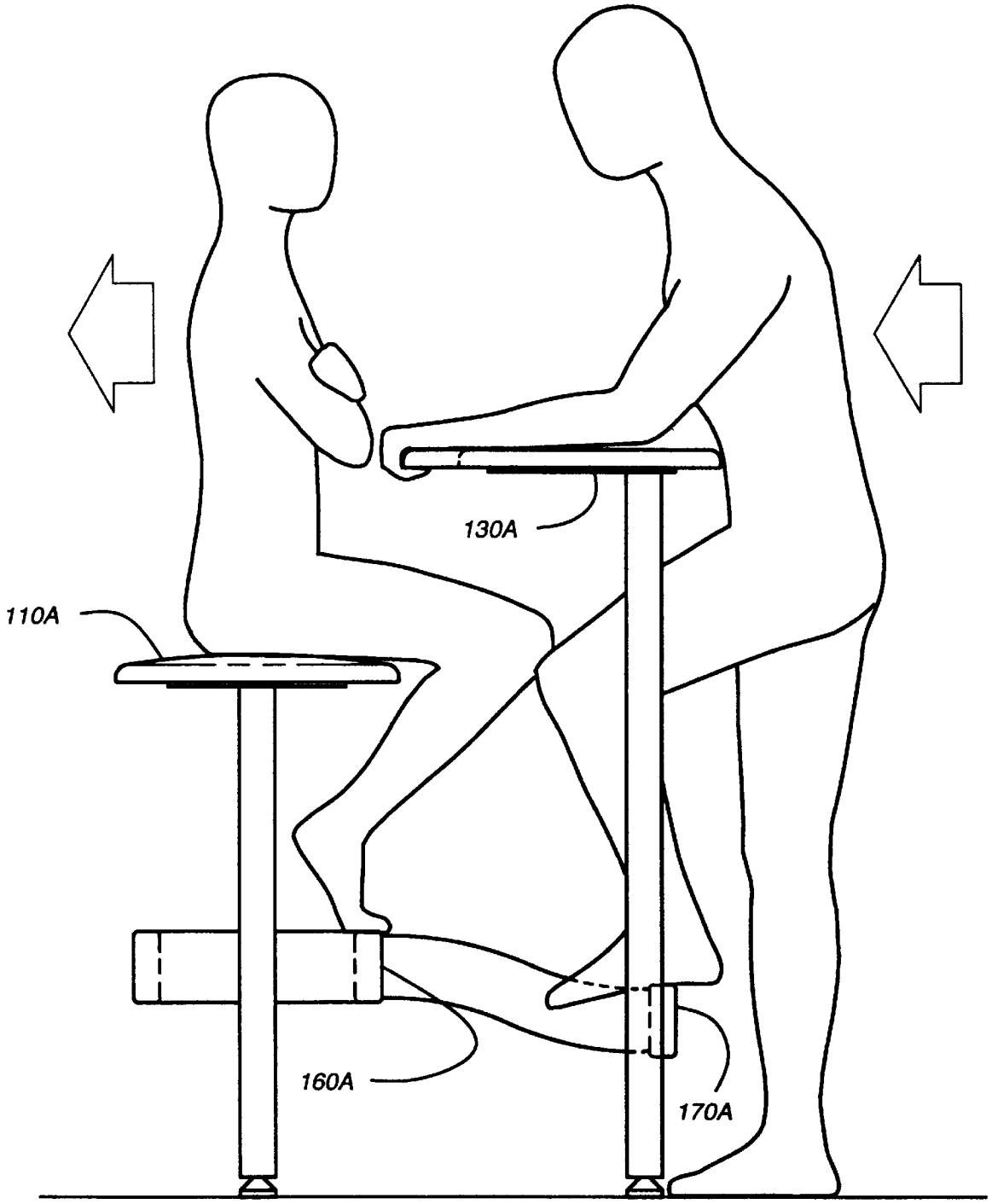
FIG. 1D SOCIAL INTERACTION

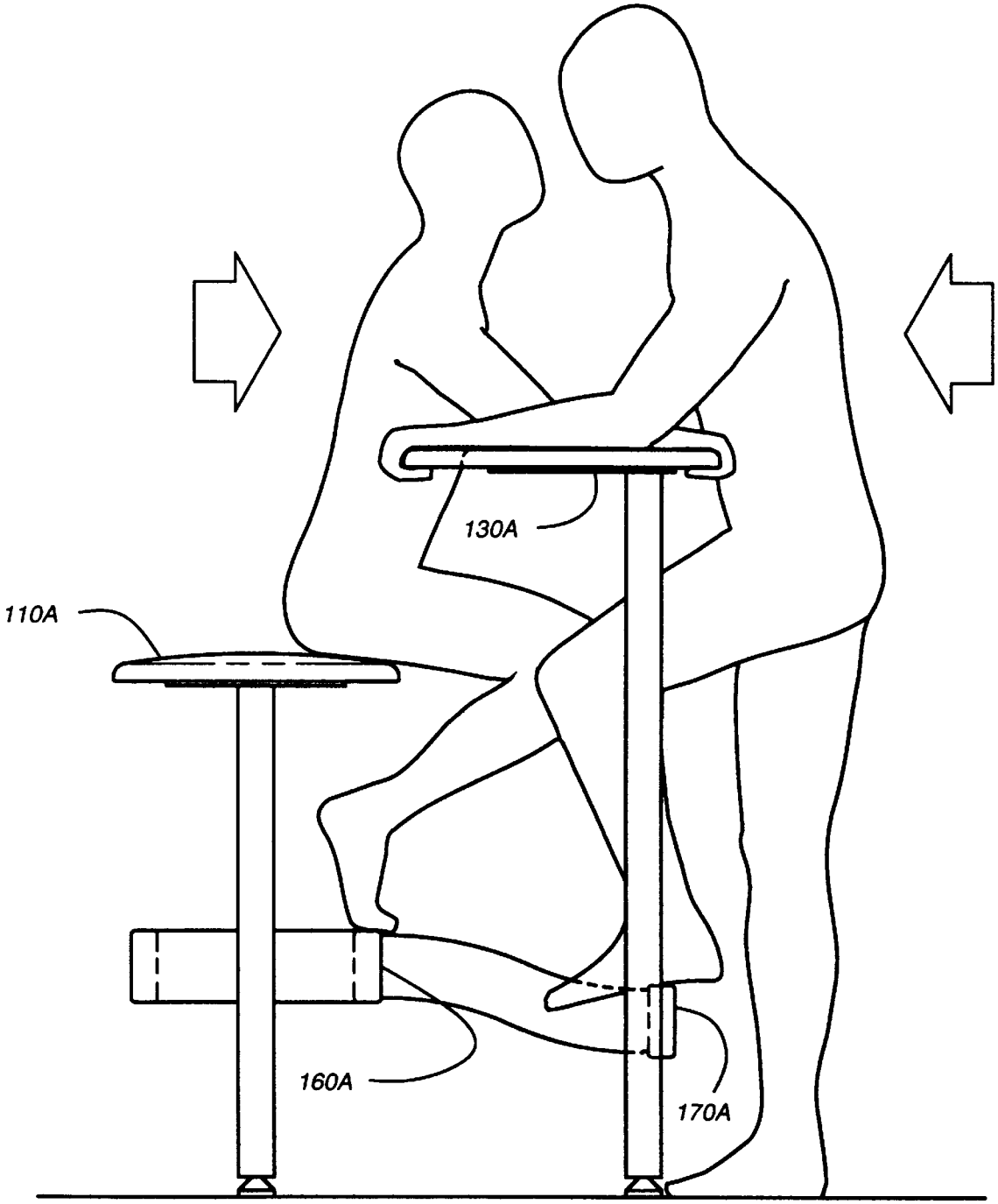
FIG.1E SOCIAL INTERACTION

STOOL WITH ATTACHED TABLE

FIELD OF THE INVENTION

The present invention relates to improvements in the field of stools, and more particularly to stools having an attached near-horizontal or horizontal surface.

DESCRIPTION OF RELATED ART AND BACKGROUND OF THE INVENTION

The present invention is an improvement over existing developments in the art in that it combines the functions of a stool and a table in one free standing piece of furniture, having unique advantages intimately related to its design, as will be disclosed herein. A stool has utility, as we are aware, and a number of improvements on the basic design of a stool have been patented. An example is the U.S. Pat. No. 4,998,774 issued Mar. 12, 1991 to Huff et al. for a "Stool Seat". In this case the inventor devised an air cushion for the seat of the stool. Also tabletop and seating combinations have been designed in a variety of configurations, each having its own advantages and disadvantages. The "Combination Desk and Seat", U.S. Pat. No. 3,606,451 issued Sep. 20, 1971 to J. B. Brownfield et al. shows such a desk and seat designed to be fixedly attached to the floor, arranged as one would the seats in a classroom or an auditorium. Likewise, U.S. Pat. No. 3,596,985 issued Aug. 3, 1971 to Raymond G. Degagne for a "Combined Table and Cantilevered Seat Assembly" shows a table and seat in which the inventor makes use of a cantilever design in supporting the seats. There is no provision for standing occupants and there are no footrails. Leong, in U.S. Pat. No. 4,738,484 issued Apr. 17, 1988 for a "Table and Stool Assembly" describes a freestanding unit having a single tabletop in combination with two stools. However, there are no footrails, and no provisions for a standing occupant. Thomas et al. in U.S. Pat. No. 4,289,350 issued Sep. 15, 1981 for a "Combined Folding Table and Seat" shows a backless seat. The invention is a folding or collapsible design, rather than a finished furniture piece or a "Ready To Assemble" (RTA) unit, does not accommodate a standing occupant, and has no footrails. Likewise Sakong, Chul H., U.S. Pat. No. 4,883,314 issued Nov. 28, 1989 shows a "Folding Table and Seat Assembly" in which the unit is collapsible or foldable for storage or transport, but again the aforementioned limitations apply. We also have a "Combined Desk and Seat for a Student" U.S. Pat. No. D322,178 issued Dec. 10, 1991 to Pons, which is a freestanding unit similar to some of the posture correcting furniture on the market in recent years. No footrest is shown, and again there is no provision for a standing occupant. These various pieces, while no doubt quite useful in their intended applications, all fall short in the application targeted by the inventor in designing the invention herein disclosed, in that they do not provide for a seated occupant to converse with a standing occupant, thereby creating an environment conducive to social interaction. Some examples of places where the invention is well suited follow. Restaurants/Clubs: fine dining—waiting area or bar, theme restaurant, fast food, casual or outdoor cafe, singles bar, micro brewery, cafeteria, etc. Specialty Shops: ice cream, donut, bagel, coffee, book, deli, etc. Public areas such as concession stands: airport, race track, ball park, amusement park, public park, shopping mall, trade show, convention, etc. Recreation centers: billiards, bowling, skating, etc. Kitchen: telephone table, breakfast bar, window seat, companion's chair, party stool, etc. Rec-room: billiard chair, party stool, video game table, T.V. tray or table, micro workbench, etc. Also other locations such as an office, school, manufacturing, etc, Other applications will occur to the user. Individual units might be readily separated or combined and arranged to provide relative privacy or intimacy, as the occupant desires, as well as the desired geometrical or seating arrangement. It is desirable to have a unit of furniture in which comfortable accommodations can be made both for a seated occupant, and a standing visitor or occupant, providing each with an adequate area of personal space, while also being conducive to increased intimacy, and allowing optimum separation from each adjacent unit. Further, the unit of furniture should be of such a nature that it is readily constructed of materials, and in a configuration that provides a level of comfort consistent with its intended use, and likewise allow an appearance which will blend in with the decor and architecture of the location in which it is used. As an added advantage, the present invention is inherently stable because the table support and the stool support are effectively tied together. This feature gives greater stability than is reasonably practical with either a table or a stool alone.

OBJECTS OF THE INVENTION

Having thus defined the intended market and setting of the inventor's creation, it is an objective of this invention to provide a table and stool assembly, which is conducive to an autonomous seating arrangement.

An object is to accommodate one standing and/or one sitting occupant in relative comfort.

Another object is to accommodate multiple standing and/or sitting occupants, in any combination.

Further, an object is to allow combination of units of the invention to accommodate any number of seated and/or standing occupants.

It is also an objective to provide a stool and table assembly whose use might encourage social interactions.

To this end, it is an object to provide a seating/standing arrangement conducive to social intimacy.

It is also an object to provide an increased level of privacy in a crowded environment.

Again, it is an object to provide a seating/standing arrangement conducive to group interaction.

To this end it is an object to provide accommodation for multiple seating arrangements, or for seating and standing arrangements.

Further, it is an object to provide an item or article of furniture accommodating at least one seated and at least one standing occupant which is well suited to a wide range of applications or locations.

Likewise it is an object to provide an article of furniture in which the seated occupant has minimal obstruction to leg movement for ingress or egress.

Further it is an object to provide an article of furniture wherein leg clearance is not compromised by the relative arrangements of multiple units.

Yet a further object is to provide an article of furniture in which a standing occupant has minimal obstruction to leg movement and foot placement Yet still a further object is to provide an article of furniture in which adjacent placement of units is not inhibited by the support structure.

DESCRIPTION OF THE DRAWINGS

FIG. 1B is an outline view of an alternate embodiment of the invention showing use of the invention in social interaction by two occupants.

FIG. 1C is an outline view of an alternate embodiment of the invention showing use of the invention in social interaction by two occupants.

FIG. 1D is an outline view of an alternate embodiment of the invention showing use of the invention in social interaction by two occupants.

FIG. 1E is an outline view of an alternate embodiment of the invention showing use of the invention in social interaction by two occupants.

DESCRIPTION OF THE PREFERRED EMBODIMENT

In the case of this particular invention, the preferred embodiment can and will take a variety of shapes and configurations, largely dependent on styling choices, construction materials and methods chosen, and the intended use of the product, etc. It therefore becomes necessary to apply a great degree of latitude in defining any one embodiment as singularly preferred over all others. In an effort to provide a reasonable modicum of definition a representative group of samples have been chosen having the generally applicable operative features embodied in any preferred construction.

Figure 1:
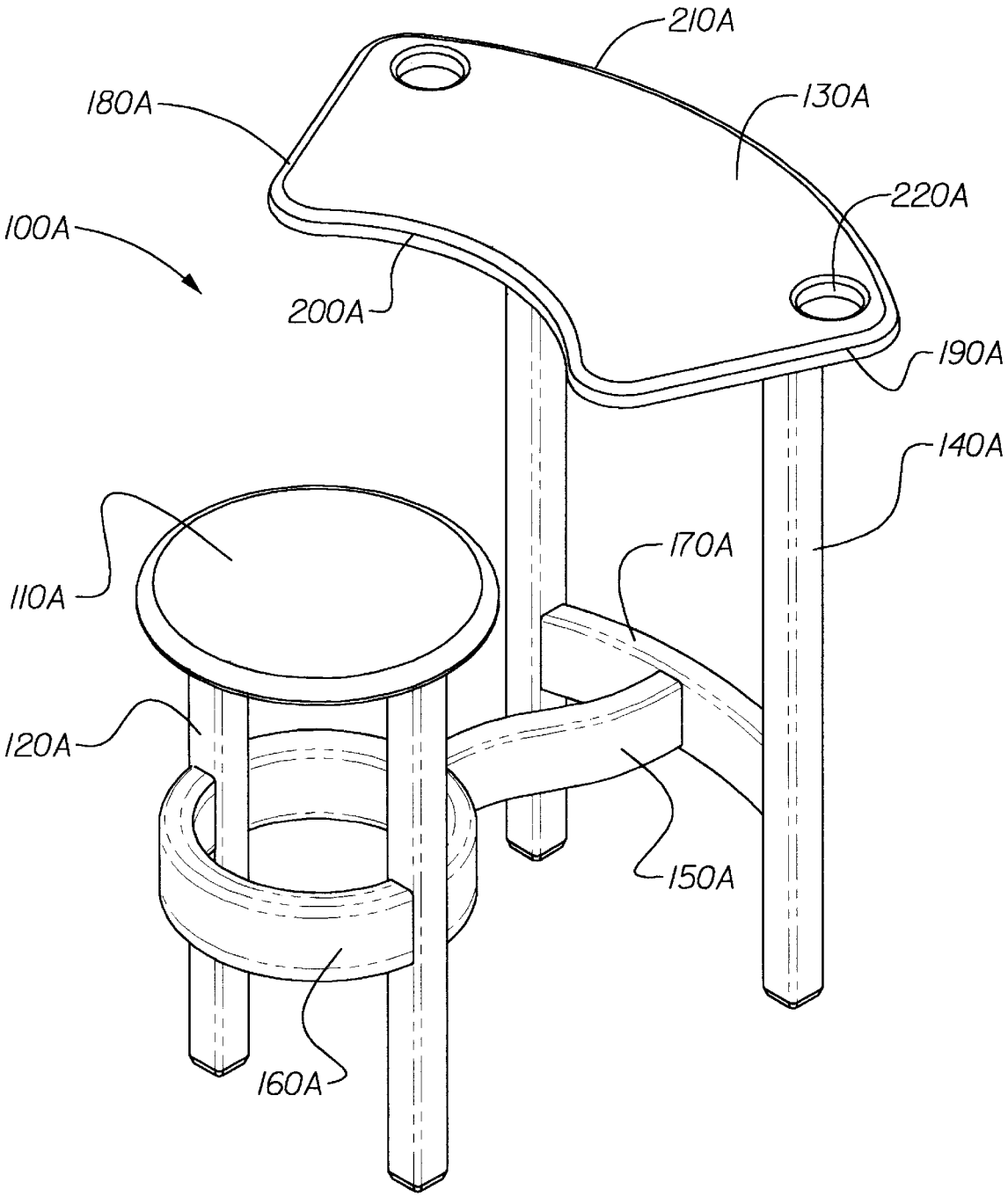
FIG. 1 is an isometric view of one embodiment of the invention showing the primary features thereof.
Figure 2:
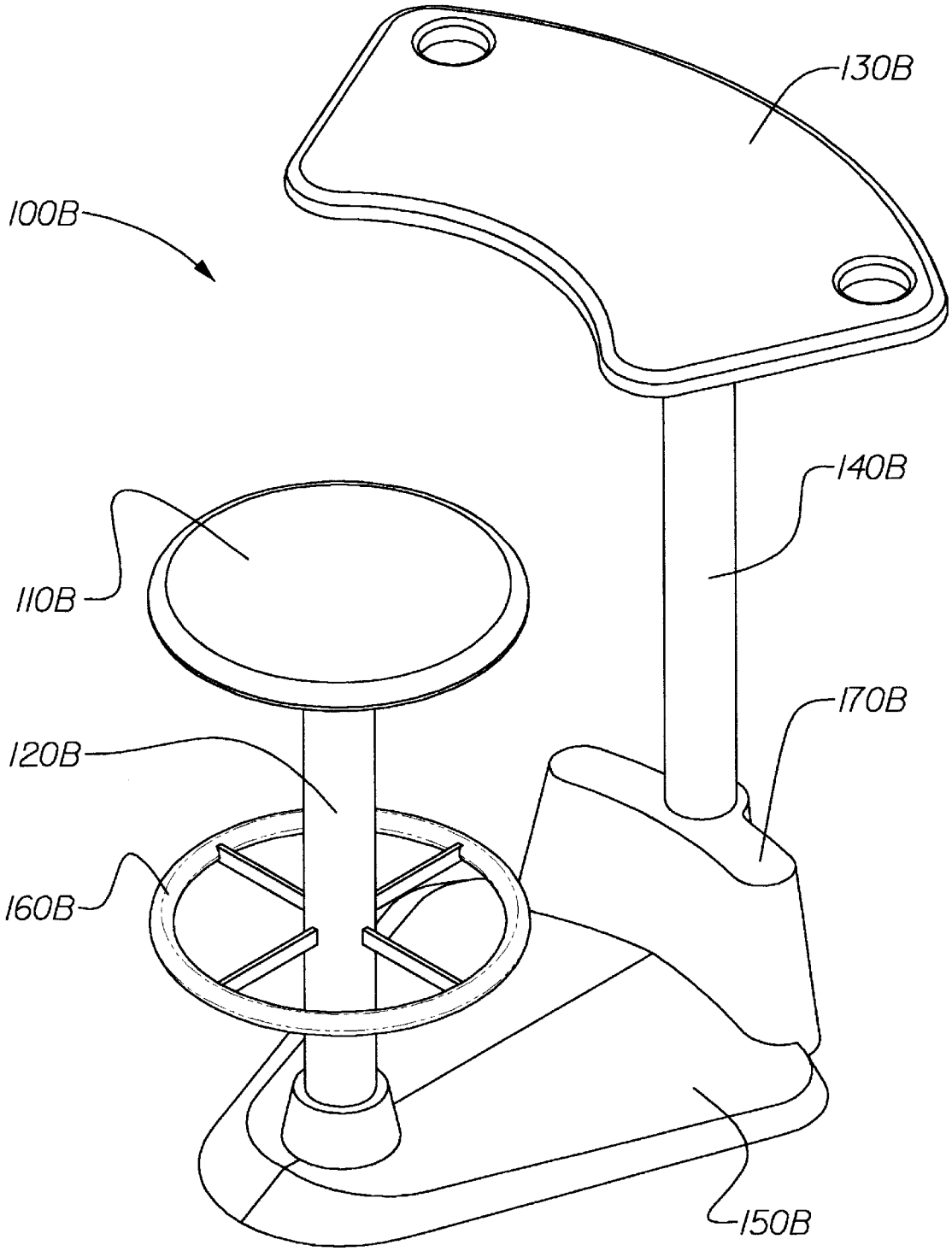
FIG. 2 is an isometric view of an alternate embodiment of the invention showing the primary features thereof.
Figure 3:
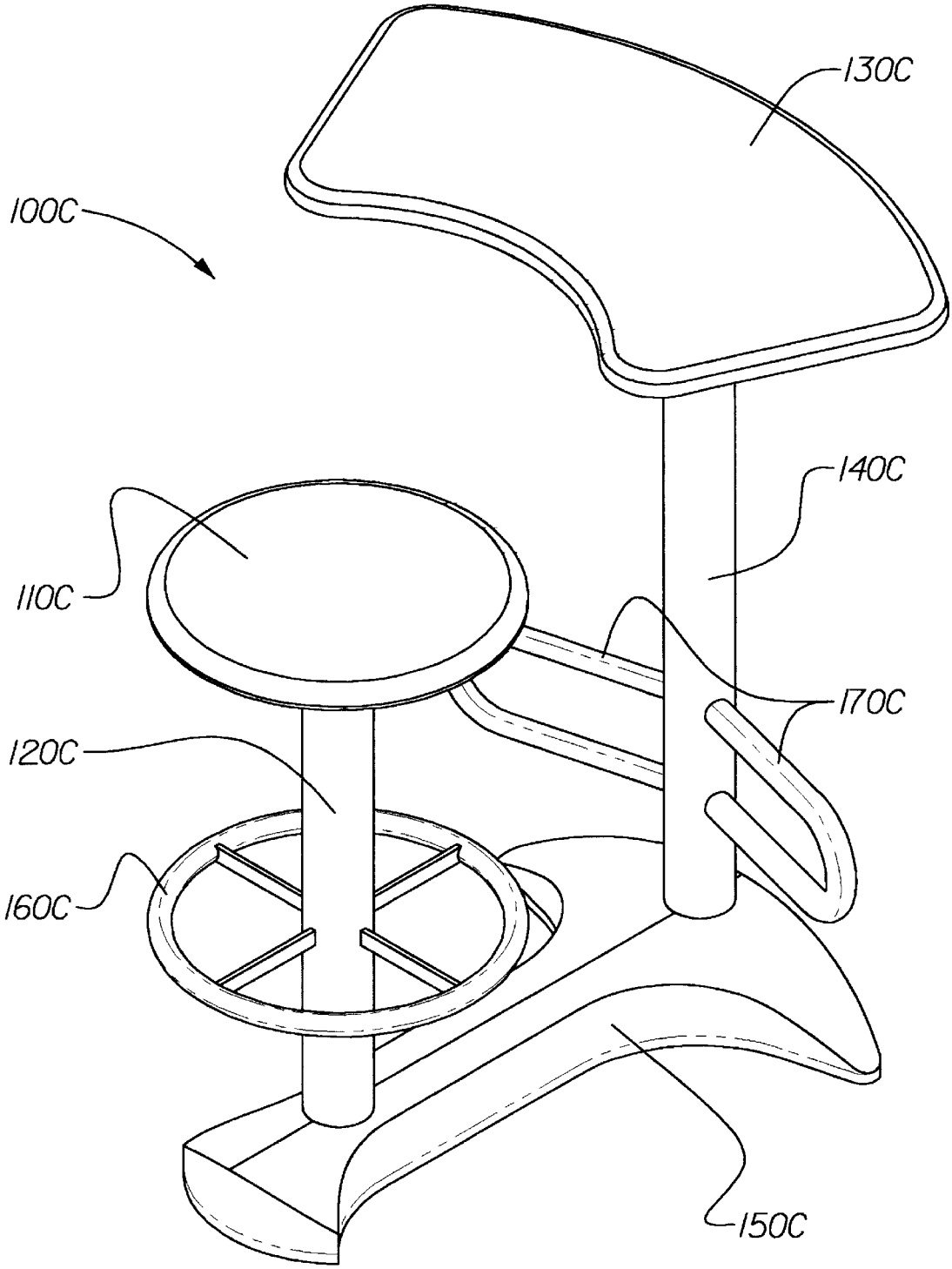
FIG. 3 is an isometric view of another alternate embodiment of the invention showing the primary features thereof.
Figure 4:
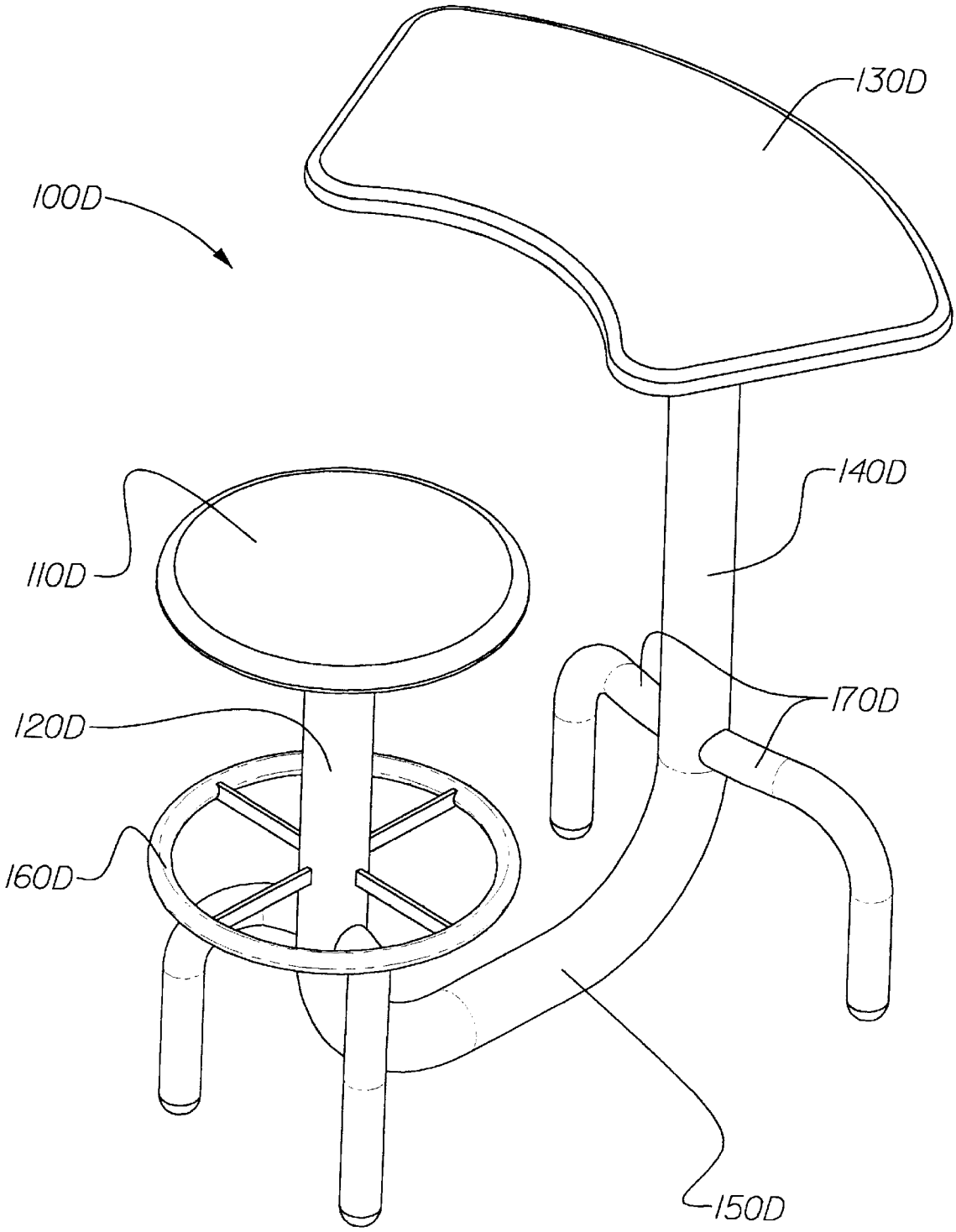
FIG. 4 is an isometric view of yet another alternate embodiment of the invention showing the primary features thereof.
Figure 5:
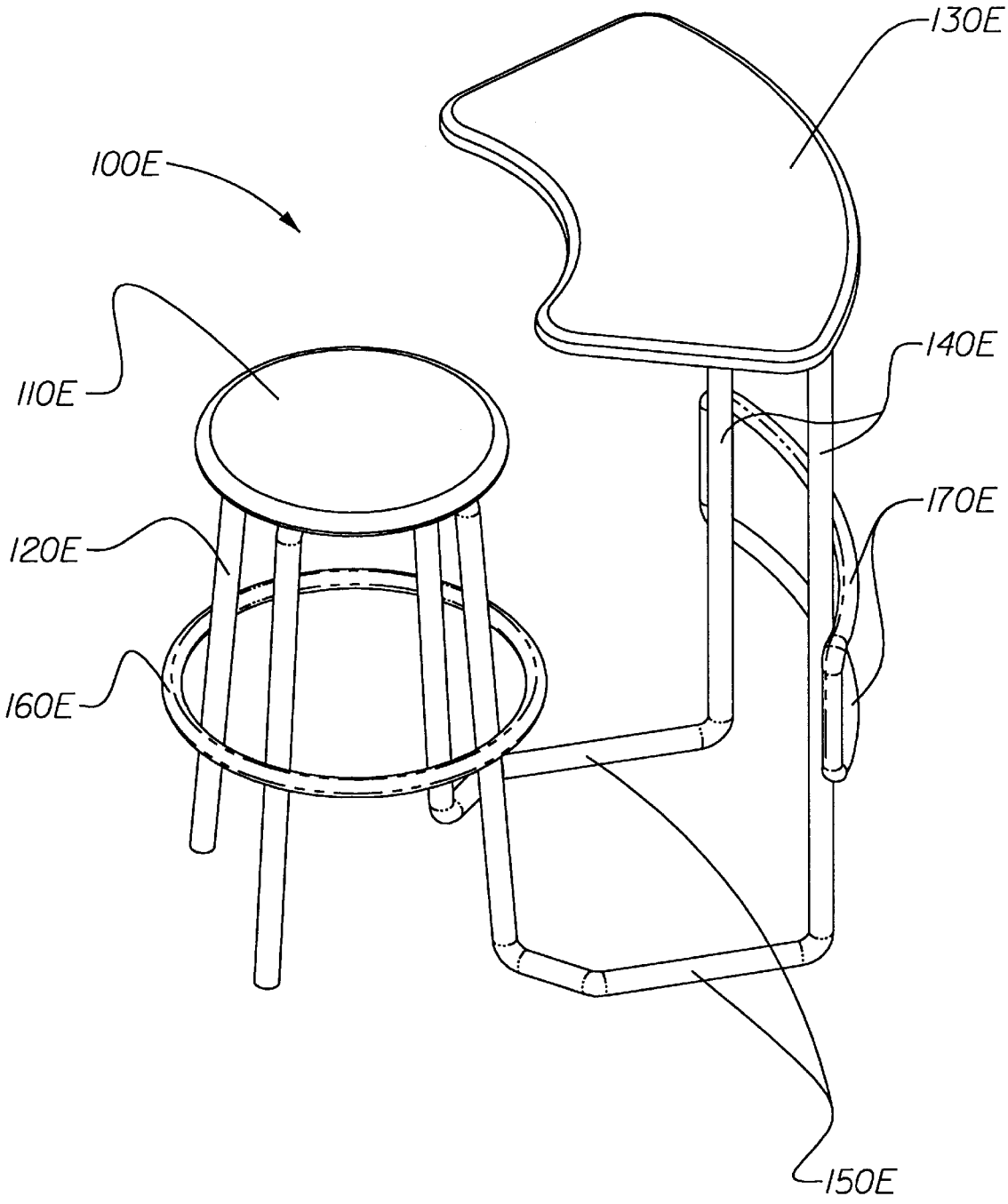
FIG. 5 is an isometric view of still another alternate embodiment of the invention showing the primary features thereof.

FIG. 1 shows a type of design which is generally suitable for construction from metal or wood and wood related materials and methods such as are commonly available and in current use, as well as plastics, composites or other materials and methods. This embodiment therefore lends itself well to construction on existing manufacturing lines in the furniture and cabinetry industries where wood, plastics, laminates, composites, tubing, sheet metal, and the like are used. This construction would be attractive and useful in casual settings such as a bar or diner that caters to the downtown lunch and happy hour crowd, where a number of units would preferably be arranged singly or in pairs. It would also be attractive for an airport setting such as a food court, or bar and grill. FIGS. 2–4 show differing construction methods and styling, and the invention can be differentiated to address different market sectors. The invention may be manufactured for "knock-down" flat packaging, known in the industry as "ready to assemble" (RTA). In this case the components are unassembled or partially assembled and packaged in such a way as to use the smallest possible space, thereby reducing inventory and shipping costs. Although the embodiment shown in FIG. 5 is especially conducive to this type of construction, the other embodiments may likewise be constructed in this manner.

The features of the preferred embodiment would include at least, a seat or seating means of a type and construction similar to a stool, a table or similar horizontal or near-horizontal surface, and a support member supporting and connecting the two. The connecting and support member rests upon the ground, or other surface or structure and may be attached thereto or embedded therein.

Figure 6:
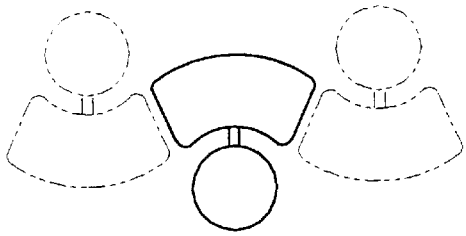
FIG. 6 is a schematic diagram of the invention showing one method of combining the devices.
Figure 7:
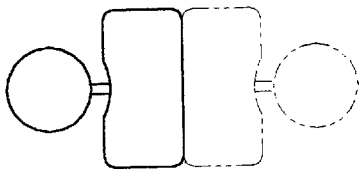
FIG. 7 is a schematic diagram of the invention showing another method of combining the devices.
Figure 8:
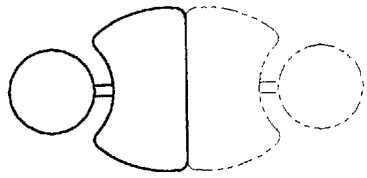
FIG. 8 is a schematic diagram of the invention showing yet another method of combining the devices.

Referring now to FIG. 1 a stooltable assembly 100A through 100H (100A–H) has a seating means or seat 110A–F, 110G1 & G2, and 110H1 & H2, which may be made rotatable by the use of a common type of commercially available bearing, a horizontally planar surface or table 130A–H, a connecting and support member consisting of at least one seat support member 120A–F, 120G1 & G2 and 120H1 & H2, at least one table support member 140A–H and at least one connecting member 150A–H. A footrest 160A–F, 160G1 & G2 and 160H1 & H2 and a standing footrest 170A–H are also provided. In a typical embodiment of the invention, a left edge 180A–H and a right edge 190A–H of the table 130 have an angular spaced apart relationship to each other and to the seat 110 such that at least more than one stooltable assembly 100 can be placed adjacent each other, allowing their use as either freestanding individual units, or as components of a modular multiple seat system, either positioned adjacently, or physically attached together. A possible range of angles might be from about 60 degrees to about 270 degrees, with a preferred range of angles from 60 to 90 degrees. It should be apparent to a practitioner of the art that the angular relationship of the edges 180,190 can limit the number of units which can be positioned next to or attached to each other, or allow an alternating, serpentine, or other geometrical or asymmetrical arrangement of units constrained only by space considerations and the user's imagination, differing angles allowing differing possible combinations. For example, a 270-degree table would only allow two units to be positioned adjacent each other, but would maximize usable table area. Multiple units having different angles wherein the angles of one table are dissimilar from that of the next, or wherein the edges have dissimilar angles relative to the stool and table centerline may also be used to advantage. The table 130 is not restricted to a four sided figure, but may have a wide range of outlines, an example of which might be a five sided figure formed by lopping off one corner of a square or rectagonal top, the resulting additional edge being adjacent the seat 110. With this arrangement four units may be combined to provide four seating locations, or again an alternating or asymmetrical arrangement may be used. The additional edge so provided may be curved, linear, irregular, etc., but does have a bearing on the function and utility of the table 130 depending on its intended use, in that the amount of surface area closest to the seated occupant will be determined by this edge configuration. More conventional layouts such as a rectangle may be used as well, where the seat 110 is positioned along one side, or in a cutout along one side. Also, the table may be oval or round, round with a cutout, half-round, half-round with a cutout, or any such variation. Since the table 130 may be of virtually any shape, regular or irregular, units may be designed to be positioned next to each other along any of their respective edge or edges, except that edge nearest the seat 110. More than one arrangement of assembly 100 may be used in a setting, as shown in FIGS. 6 through 8. By design this does not sacrifice ingress/egress in terms of leg position, so that as the units are grouped leg clearance is maintained for all occupants, allowing increased flexibility in arrangements.

An ergonomic and esthetic function is served by an inner edge 200A–H and an outer edge 210A–H, bearing in mind the occupants' use of these surfaces, in which the seated occupant may use the inner edge 200 as a backrest, and the standing occupant may lean against the outer edge 210.

Typically, the table support will be of a cantilevered design, which in combination with the design of the connecting member 150 provides greater stability with a smaller footprint and less structural encumberments to movement by the occupants than existing designs or separate components. This design allows for a narrow table top, from the inner edge 200 to the outer edge 210, providing leg clearance for the seated occupant while eliminating the need for a table support member which extends into the area of the standing occupant or the adjacent unit.

A relatively narrow tabletop is more conducive to intimacy and may be provided by using other constructions.

In one embodiment, padding may be provided for one or more of the surfaces 200,210,180,190, and the inner edge 200 can double as a backrest. An optional feature shown in FIG. 1 but equally applicable to any embodiment is a cup holder or recess 220, provided to hold a container for beverages or the like. A padded seat, seat back, modesty panel depending from the table or support, storage rack, shelf or bin, etc. likewise may be provided. Also, as another alternative embodiment, the table 130 and/or seat 110 may be made adjustable in terms of elevation, rotation or even linearly on the horizontal plane by the use of innumerable methods and mechanisms well known in the art such as a sliding-tube/pinch-bolt or detent arrangement. Multiple units at multiple fixed heights may be provided. In this fashion, a tiered system of seating may be arranged, as to enhance viewing such as in arena seating, or for other purposes such as traffic and activity control as in bar and/or restaurant seating. In alternate embodiments FIGS. 2–5 the connecting member 150 is positioned low enough to provide "swing through" leg clearance, so that the seated occupant need not lift their feet to spin around, and in all cases plentiful ingress and egress space is provided, regardless of the arrangement of adjacent units. Each embodiment of the invention contains the same elements 100A–D through 170A–D. The footrest and standing footrest 160 & 170 provide for an increased comfort level, especially in the case of the occupant seated on the stool portion, and are therefore generally desirable elements.

Figure 11:
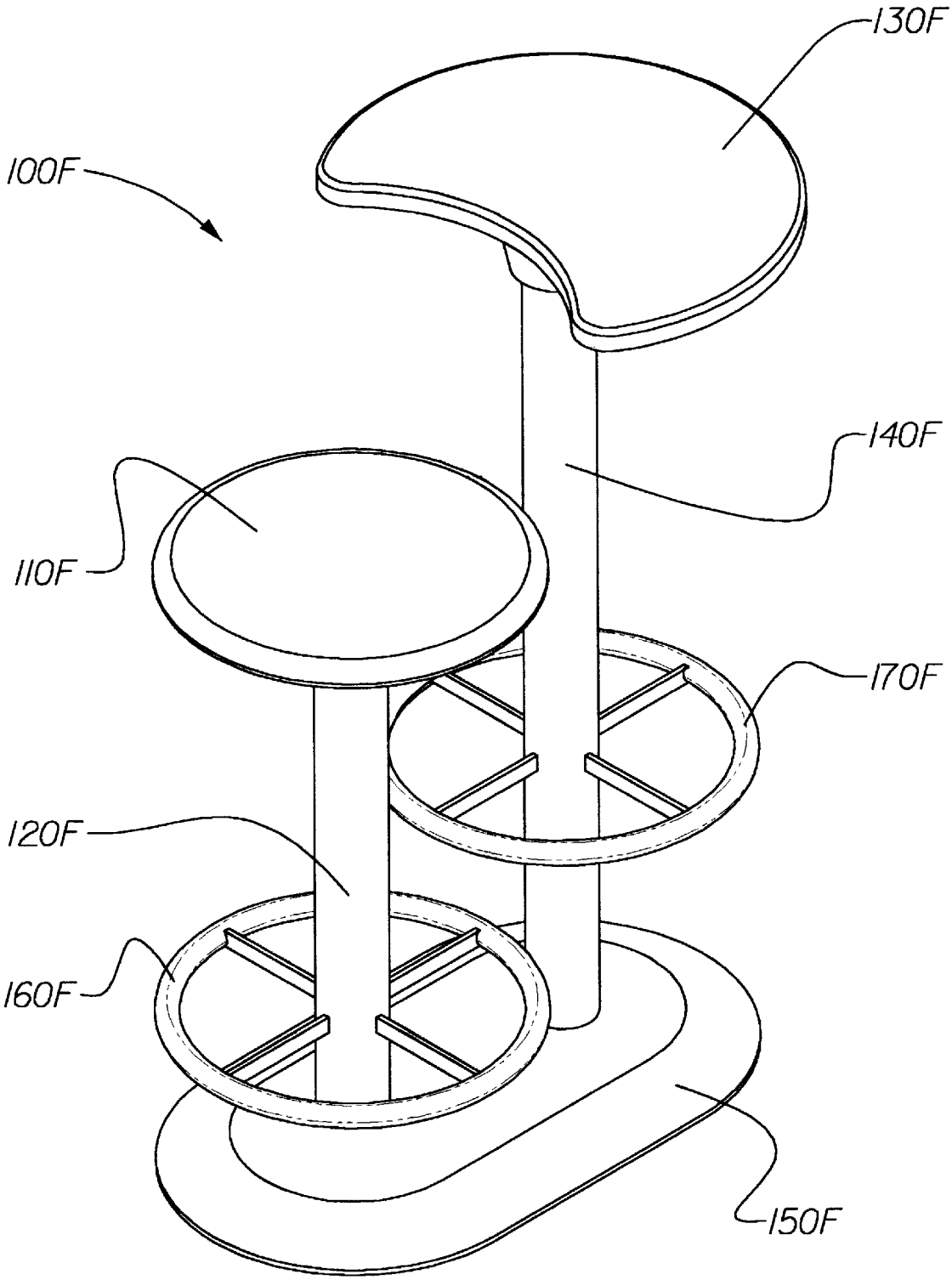
FIG. 11 is an isometric view of yet another alternate embodiment of the invention showing the primary features thereof.

Another embodiment shown in FIG. 11 varies in that the seated occupant straddles or has one leg on either side of at least one element of the connecting and support member. This embodiment can be constructed to use less space, and at less cost.

Also, it is possible to anchor any embodiment of the invention to the floor rendering it stationary, and in this case in some embodiments such as shown in FIGS. 3, 4, and 5 the support structure can be simplified by the elimination of unnecessary parts.

Figure 9:
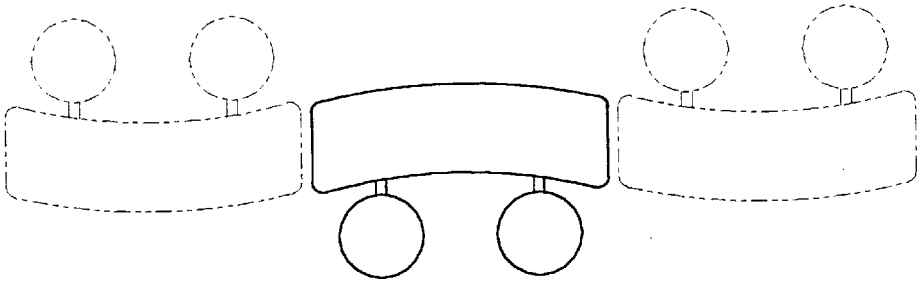
FIG. 9 is a schematic diagram of the invention showing still another method of combining the devices.
Figure 10:
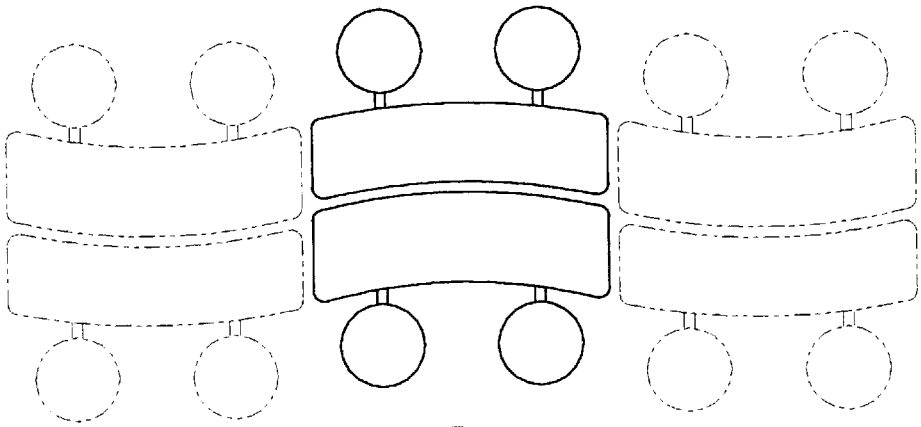
FIG. 10 is a schematic diagram of the invention showing yet still another method of combining the devices.
Figure 12:
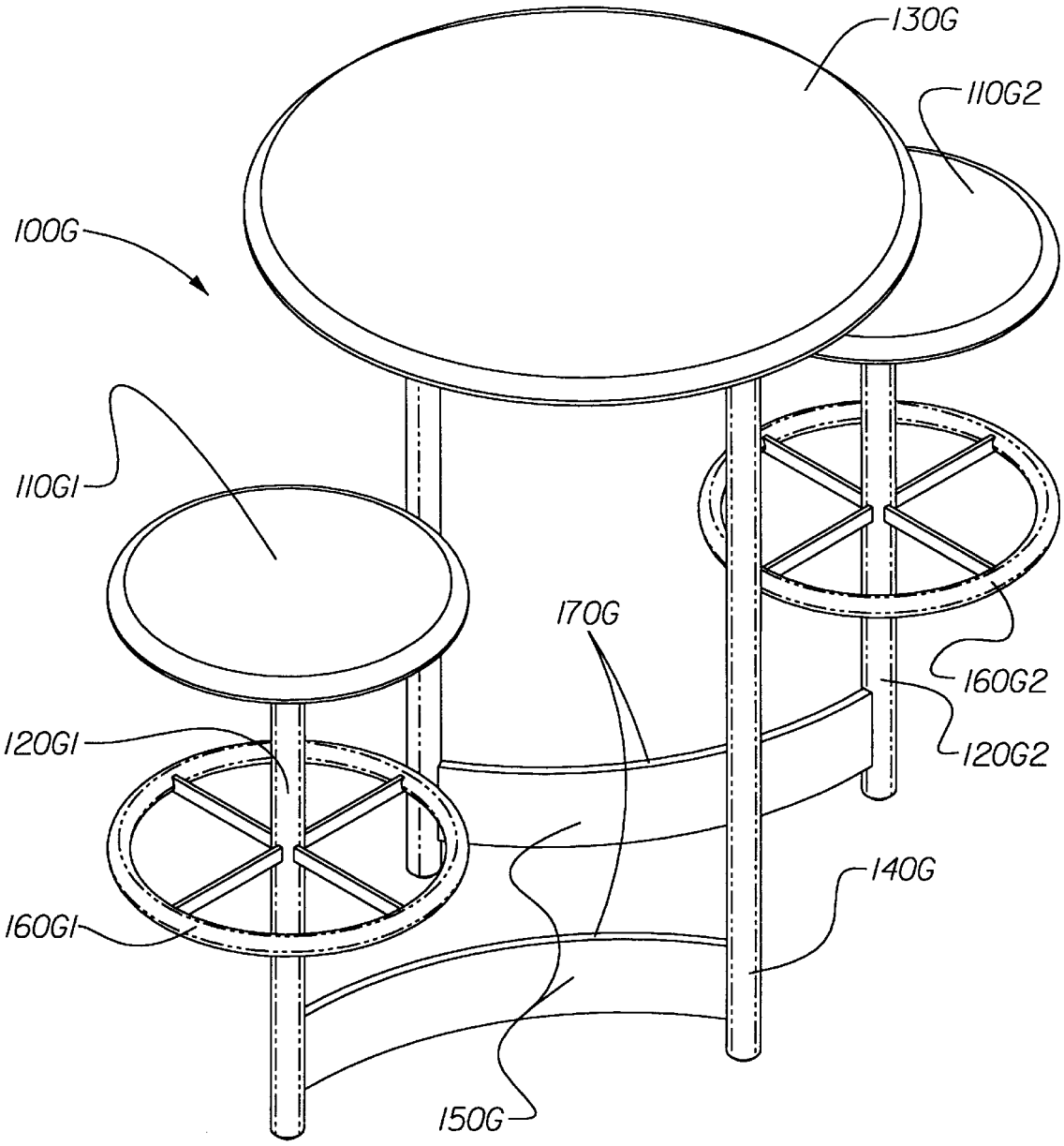
FIG. 12 is an isometric view of a two seat alternate embodiment of the invention showing the primary features thereof.
Figure 13:
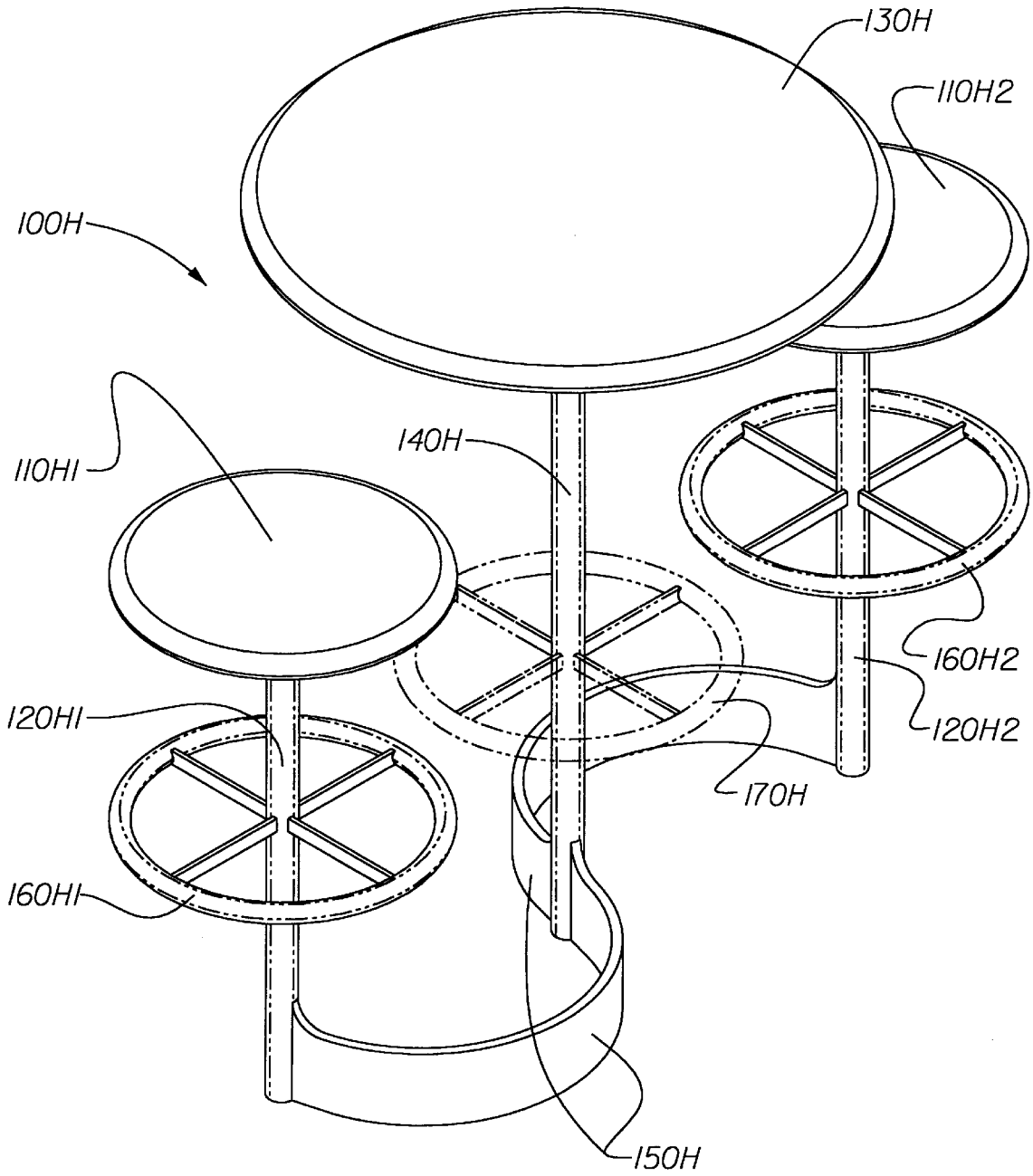
FIG. 13 is an isometric view of another two seat alternate embodiment of the invention showing the primary features thereof.

FIGS. 6 & 7 depict two of the widely varying number of arrangements possible with this invention, and one can easily envision quite a few more just from these examples. FIG. 8 shows an alternate edge contour. FIG. 9 is demonstrative of what can be done with the alternate embodiment having two seated occupants per device, and FIG. 10 illustrates the use of doubled devices as matched pairs. Units having the table rotated 180 degrees relative to the seat as in the case of matched pairs as shown in FIG. 10, provide increased seating density. Although shown on the same side as the first seat as in FIG. 9, the second seat may be in any location. In such a case the connecting member 150 may be configured in a variety of arrangements, such as in an "s" shape when viewed from above, or a diamond, offset parallel lines, offset curved lines, etc. as shown in FIGS. 12 and 13. The standing footrest 170H may be provided as shown in the phantom lines in FIG. 13, or may be made an integral part of the connecting and support structure as shown in FIG. 12. The second seat may be adjacent to the first one, directly across from it, diagonally across from it, etc.

Having therefore shown and described the invention in sufficient clarity to allow a practitioner of the art to make and practice the invention without undue experimentation, and taking into consideration the wide range of variations and alternate embodiments enabled thereby, this disclosure, in keeping with the doctrine of equivalents, should not be taken as limiting the scope of the invention to the literal disclosures contained herein, but as including all protections afforded by law.

The inventor therefore claims:

1. A unitary stool and table device to enhance social interaction between seated and standing humans, comprising:

a) a support structure comprising:
- I) at least a table support member;
- II) at least a stool support member;
- III) a connecting means;
- IV) said connecting means connecting said stool support member to said table support member;

b) a table top positioned at a height approximately that of counter tops and bar counter tops, height of said tops ranging from approximately 32 to 45 inches above the ground, as identified in design standards followed in the furniture design, architecture and interior space design professions, and comprising:
- I) a predetermined width;
- II) a predetermined length;
- III) said width comprising a portion between a front side and a rear side;
- IV) said length comprising a portion between at least two lateral sides;
- V) said width being approximately 10 to 20 inches which is approximately the depth of a knee clearance zone for a seated human, said depth ranging from approximately 12 to 18 inches, as identified in anthropometric standards followed in the furniture design, industrial design and engineering professions and;
- VI) said length being approximately 12 to 60 inches, 12 inches being approximately ½ the width of a human activity zone, and 60 inches being approximately twice the width of said activity zone, the width of said activity zone being not less than 24 and not more than 30 inches, as identified in said design standards;

c) a stool positioned at a height approximately that of stools for use with said counter tops and bar counter tops; height of said stools above the ground being approximately 7.5 to 14.5 inches less than that of said tops, as identified in said design standards;

d) said stool positioned at said rear side of said table top;

e) said stool connected to and supported by said stool support member;

f) said table top connected to and supported by said table support member;

g) said rear side of said table top providing a leaning area for a seated human, when the human is sitting on said stool;

h) said front side and said lateral sides providing leaning areas for a standing human;

i) said support structure positioned approximately in a zone identified by the outer perimeter of said table top, the outer perimeter of said stool and the space between, and allowing;

I) unencumbered standing access to said front side and said lateral sides by a human, when human is standing at said device;

II) placement of another said device adjacent to said device;

j) a foot rest positioned substantially at the perimeter of said stool;

k) said foot rest being substantially horizontal and positioned below said stool approximately in a range of approximately 5 to 25 inches below said stool;

l) said foot rest connected to said support structure;

m) said device being compatible for use with freestanding stools; said freestanding stools being types commonly used with counter tops and bar counter tops; and n) an optional standing foot rest for use by a standing human attached to said device and positioned approximately within a perimeter of said table top;

o) whereby the seated and standing humans can;

I) comfortably eat, write and work at said table top;

II) interact at a relatively common eye level; and

III) utilize said table top to control social proximity.

2. The device of claim 1 further comprising:

a) said standing foot rest being substantially horizontal and positioned at a height approximately in a range of approximately 3 to 20 inches above the ground;

b) said standing foot rest connected to said support structure.

3. The device of claim 1 wherein said standing foot rest is integral with said support structure.

4. The device of claim 1 wherein the height of said table top is approximately 32 inches above the ground and said stool is positioned approximately 7.5 to 10 inches below said table top, dimensions being consistent with those of kitchen work counters as identified in said standards.

5. The device of claim 1 wherein the height of said table top is approximately 34 to 44 inches above the ground and said stool is positioned approximately 12 to 14.5 inches below said table top, dimensions being consistent with those of general office work counters as identified in said standards.

6. The device of claim 1 wherein the height of said table top is approximately 42 to 45 inches above the ground and said stool is positioned approximately 11 to 12 inches below said table top, dimensions being consistent with those of lunch counters and bar counter tops as identified in said standards.

7. The device of claim 1 wherein said device is an element of a modular system comprising more than one device placed in a manner to enhance social interaction between humans occupying said devices.

8. The device of claim 1 wherein said rear side of said table top acts as a back rest for a seated human, when human is sitting on said stool and facing away from said table top.

9. The device of claim 1 wherein at least one side of said table top is curved.

10. The device of claim 1 wherein a portion of said rear side of said table top is approximately concentric with a perimeter of said stool.

11. The device of claim 1 wherein at least a portion of said table top is extended to provide at least an arm rest for a human, when the human is sitting on said stool.

12. The device of claim 1 wherein at least one edge of at least one said table top is configured to adjoin at least one matching edge of at least one other said table top.

13. The device of claim 1 wherein said support structure provides clearance for a human's legs, when human is sitting on said stool and rotating 360 degrees.

14. The device of claim 1 wherein said support structure comprises a barrier for a human's legs; said barrier prohibiting a human from rotating 360 degrees, when human is sitting on said stool.

15. The device of claim 1 wherein dimensions identified in said design standards and said anthropometric standards are capable of reduction from 0% to approximately 50% said reduction of said dimensions resulting in said device accommodating smaller humans, dimensions of said smaller humans being identified in said anthropometric standards.

16. The device of claim 1 wherein dimensions identified in said design standards and said anthropometric standards are capable of reduction from approximately 50% to 99% to accommodate miniature replicas of humans.

17. The device of claim 1 wherein dimensions said identified in said design standards and said anthropometric standards are capable of enlargement from 0% to approximately 115% to accommodate larger humans.

18. The device of claim 1 wherein dimensions said identified in said design standards and said anthropometric standards are capable of alteration to create a hybrid device, said hybrid device accommodating a sitting child when child is sitting on said stool, and a standing adult when adult is standing at said table top, said alteration resulting in said device having dimensions consistent with a child art and craft center, said center identified in said design standards.

19. The device of claim 1 further comprising at least one recess in said table top wherein at least an item may be placed.

20. The device of claim 1 further comprising padding affixed to at least an edge of said table top.

21. The device of claim 1 wherein said stool is rotatable.

22. The device of claim 1 wherein said stool is padded.

23. The device of claim 1 further comprising a back rest connected to said stool.

24. The device of claim 1 also comprising a modesty panel depending from said table top.

25. The device of claim 1 also comprising a modesty panel connected to said support structure.

26. The device of claim 1 also comprising a shelf depending from said table top.

27. The device of claim 1 also comprising a shelf depending from said stool.

28. The device of claim 1 also comprising a shelf connected to said support structure.

29. The device of claim 1 also comprising at least one vertical adjustment relative to said stool and said table top whereby the relative height of said stool to said table top is changeable.

30. The device of claim 1 also comprising at least one rotative adjustment relative to said stool and said table top whereby the position of said stool is rotatably adjustable.

31. The device of claim 1 further comprising at least one horizontal adjustment relative to said stool and said table top whereby the relative proximity of said stool to said table top is adjustable.

32. The device of claim 1 wherein said support structure is collapsible thereby allowing compact storage and shipping of said device.

33. The device of claim 1 wherein two or more of said device are adjacently positioned, thereby providing a module for increased social interaction.

34. The device of claim 33 wherein at least two of said devices adjacently positioned face substantially the same direction and allow;

a) clearance between stools of devices said adjacently positioned for a human, when human is approaching said stool of one said device from a side near a device said adjacently positioned, consistent with said design standards;

b) clearance between stools of devices said adjacently positioned for humans' elbows, when humans are seated at said stools of said devices said adjacently positioned, consistent with said design standards.

35. The device of claim 33 wherein at least two of said devices adjacently positioned face substantially opposite directions and allow clearance between said stool of one said device and said support structure of said device adjacently positioned for a human's knee, when human is sitting on said stool of one said device and facing said device adjacently positioned consistent with said design standards.

36. The device of claim 33 wherein said at least two devices face substantially a single point.

37. The device of claim 1 further comprising:

a) a second stool;

b) at least a second stool support member;

c) a second connecting means;

d) said second stool support member being connected to said support structure by said second connecting means;

e) said second stool being connected to and supported by said second stool support member.

38. The device of claim 37 wherein dimensions identified in said design standards and said anthropometric standards are capable of reduction from 0% to approximately 50%, said reduction of said dimensions resulting in said device accommodating smaller humans, dimensions of said smaller humans being identified in said anthropometric standards.

39. The device of claim 37 wherein dimensions identified in said design standards and said anthropometric standards are capable of reduction from approximately 50% to 99% to accommodate miniature replicas of humans.

40. The device of claim 37 wherein dimensions identified in said design standards and said anthropometric standards are capable of enlargement from 0% to approximately 115% to accommodate larger humans.

41. The device of claim 37 wherein dimensions identified in said design standards and said anthropometric standards are capable of alteration to create a hybrid device, said hybrid device accommodating a sitting child, when child is sitting on said stool, and a standing adult, when adult is standing at said table top, said alteration resulting in said device having dimensions consistent with a child art and craft center, said center identified in said design standards.

42. The device of claim 37 wherein said second stool is positioned diagonally across from said stool, relative to said table top.

43. The device of claim 37 wherein said second stool is positioned substantially across from said stool, relative to said table top.

44. The device of claim 37 also comprising a second foot rest, said second foot rest being connected to said second stool support member.

45. The device of claim 44 wherein said second foot rest is connected to said second connecting means.

46. The device of claim 37 also comprising a standing foot rest, said standing foot rest being connected to said support structure.

47. The device of claim 46 wherein said standing footrest is integral with said support structure.

48. The device of claim 1 also comprising a privacy panel connected to said table top.

49. The device of claim 1 also comprising a security panel depending from said stool.

50. The device of claim of 1 also comprising a security panel connected to said support structure.

51. The device of claim of 1 also comprising a hanger device for holding hangable objects.

52. The device of claim 1 also comprising at least one electronic coupling device; said coupling device coupling at least one electronic device with at least one electronic network.

53. A unitary stool and table device to enhance social interaction between seated and standing humans, comprising:

a) a support and connecting means;

b) a table top positioned at a height for comfortable use by a standing human and comprising;

I) a predetermined width;

II) a predetermined length;

III) said width comprising a portion between a front side and a rear side;

IV) said length comprising a portion between at least two lateral sides;

V) said width providing a space for comfortable use by at least one standing human, when human is standing at said table top;

VI) said width providing a space for comfortable use by at least one seated human, when human is sitting at said table top;

VII) said length providing a space for comfortable use by at least one standing human, when human is standing at said table top;

VIII) said length providing a space for comfortable use by at least one seated human, when human is sitting at said table top;

c) a stool positioned at said rear side of said table top, and at a comfortable distance for use of said table top by a seated human, when human is sitting on said stool;

d) said stool positioned at a height for comfortable use of said table top by a seated human, when human is sitting on said stool;

e) said table top supported by and connected to said support and connecting means;

f) said stool supported by and connected to said support and connecting means;

g) said front side and said lateral sides providing leaning areas for a standing human, when human is standing at said table top;

h) said rear side of said table top providing a leaning area for a seated human, when human is sitting on said stool;

i) at least a foot rest positioned substantially at the perimeter of said stool;

j) said foot rest being substantially horizontal and positioned at a height for comfortable use by a human, when human is sitting on said stool;

k) said foot rest connected to said support and connecting means;

l) said device allowing adjacent placement of another said device;

m) said device allowing comfortable movement around perimeter of device by a standing human, when human is utilizing said table top;

n) said table top providing a surface for holding objects;

o) said table top providing a barrier between a standing and a seated human, when said standing human is standing at said front side and said seated human is sitting on said stool;

p) said front side of said table top approximately establishing the perimeter of a comfortable knee clearance zone for a seated human, when human is sitting on said stool and facing said table top;

q) said device being compatible for use with freestanding stools, said freestanding stools being of the type compatible for use with counters and bar counter tops; and r) at least an optional standing foot rest for use by a standing human, said standing foot rest being attached to said device and positioned substantially within the perimeter of said table top;

s) whereby the seated and standing humans can;

I) occupy said device; and

II) eat, drink, work, write and socialize at said table top.

54. The device of claim 53 further comprising;

a) said standing foot rest being substantially horizontal and positioned at a height for comfortable use by a standing human, when human is standing at said table top;

b) said standing footrest being connected to said support and connecting means.

55. The device of claim 54 further comprising at least a second standing foot rest being connected to said support and connecting means.

56. The device of claim 55 wherein dimensions are capable of reduction to accommodate miniature replicas of humans.

57. The device of claim 53 wherein dimensions are capable of reduction to accommodate miniature replicas of humans.

58. The device of claim 54 wherein dimensions are capable of reduction to accommodate miniature replicas of humans.

59. The device of claim 53 further comprising;

a) a second stool;

b) a stool support and connecting means;

c) said stool support and connecting means being connected to said support and connecting means;

d) said second stool being supported by and connected to said stool support and connecting means;

e) at least a second foot rest;

f) said second foot rest connected to said stool support and connecting means.

60. The device of claim 59 wherein dimensions are capable of reduction to accommodate miniature replicas of humans.

* * * * *